US006827182B2

(12) United States Patent
Araki

(10) Patent No.: US 6,827,182 B2
(45) Date of Patent: Dec. 7, 2004

(54) ELEVATOR CONTROLLER

(75) Inventor: Hiroshi Araki, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 52 days.

(21) Appl. No.: 10/380,858

(22) PCT Filed: Oct. 17, 2001

(86) PCT No.: PCT/JP01/09107

§ 371 (c)(1),
(2), (4) Date: Mar. 18, 2003

(87) PCT Pub. No.: WO03/033390

PCT Pub. Date: Apr. 24, 2003

(65) Prior Publication Data

US 2004/0035646 A1 Feb. 26, 2004

(51) Int. Cl.[7] ..... B66B 1/06
(52) U.S. Cl. ..... 187/290; 187/296
(58) Field of Search ..... 187/290, 296, 187/297, 204; 307/64, 66; 318/375, 376, 788–816

(56) References Cited

U.S. PATENT DOCUMENTS 4,662,478 A * 5/1987 Uchino ..... 187/290
5,162,623 A * 11/1992 Tachino ..... 187/290
5,864,474 A * 1/1999 Jang ..... 363/39
5,896,948 A * 4/1999 Suur-Askola et al. ..... 187/290
6,196,355 B1 * 3/2001 Fargo et al. ..... 187/393
6,264,005 B1 * 7/2001 Kang et al. ..... 187/290
6,315,081 B1 * 11/2001 Yeo ..... 187/290
6,422,351 B2 * 7/2002 Tajima et al. ..... 187/290
6,460,658 B2 * 10/2002 Suga et al. ..... 187/290
6,732,838 B1 * 5/2004 Okada et al. ..... 187/290

FOREIGN PATENT DOCUMENTS

| | | |
|---|---|---|
| JP | 53-34245 A * | 3/1978 |
| JP | 56-117972 | 9/1981 |
| JP | 59-198275 | 11/1984 |
| JP | 59-227669 | 12/1984 |
| JP | 61-267675 | 11/1986 |
| JP | 5-338947 | 12/1993 |
| JP | 7-232872 | 9/1995 |
| JP | 8-169658 | 7/1996 |
| JP | 10-120319 | 5/1998 |
| JP | 11-199152 | 7/1999 |
| JP | 2000-236637 | 8/2000 |

* cited by examiner

*Primary Examiner*—Jonathan Salata
(74) *Attorney, Agent, or Firm*—Leydig, Voit & Mayer, Ltd.

(57) ABSTRACT

An elevator control apparatus which, when a power failure of the A.C. power source is detected, effectively and usefully uses stored power in a power accumulator and when the A.C. power source is restored, returns an elevator back to the original service to make proper operation possible. The control system includes a control for, when a power failure is detected with a power failure detector, supplying power from the power accumulator to an inverter, to control circuits, and to an illumination circuit of the elevator with a charge/discharge control circuit to continue the operation of the elevator.

14 Claims, 9 Drawing Sheets

ELEVATOR CONTROLLER

TECHNICAL FIELD

The present invention relates to an energy-saving type elevator control apparatus to which a secondary battery is employed.

BACKGROUND ART

FIG. 5 is a basic structural diagram showing a conventional elevator control apparatus to which a secondary battery is employed for controlling the elevator. In FIG. 5, reference numeral 1 denotes a three-phase A.C. power source, and reference numeral 2 denotes a converter constructed by diodes and the like for converting an A.C. power outputted from the three-phase A.C. power source 1 into a D.C. power. The D.C. power which has been obtained through the conversion in the converter 2 is supplied across D.C. buses 3.

In addition, reference numeral 4 denotes an inverter, which is controlled by a speed controller, as will be described later, for speed position control for the elevator. Thus, the inverter convert a direct current supplied through the D.C. buses 3 into an alternating current of a variable voltage and a variable frequency to supply the resultant alternating current to an A.C. motor (not shown) to rotate and drive a hoisting machine 5 of the elevator directly connected to the A.C. motor, thereby controlling ascending and descending of a car. A rope wound around the hoisting machine 5 is connected to the car and to a counter weight to allow a passenger in the car to move to a predetermined floor.

Here, the weights of the car and the counter weight are designed in such a way that they become roughly equal to each other when passengers one half the capacity get in the car. That is to say, in the case where the car is moved up and down with no load, the operation becomes a power running operation when the car is moved down, while becoming a regenerative operation when the car is moved up. Conversely, in the case where the car is moved down with the capacity load, the operation becomes the regenerative operation when the car is moved down, while becoming the power running operation when moving up the car.

In addition, reference numeral 6 denotes an elevator control circuit which is constructed by a microcomputer and the like, and which carries out the supervision/control of the whole elevator. Reference numeral 7 denotes a speed controller for carrying out the speed control of the elevator, reference numeral 8 denotes a charge/discharge control circuit, reference numeral 9 denotes a power accumulator provided across the D.C. buses 3 for accumulating therein a power during the regenerative operation of the elevator and for supplying the accumulated power to the inverter 4 together with the converter 2 during the powering operation, reference numeral 10 denotes a regenerative control circuit, reference numerals 11 and 12 respectively denote a regenerative control gate and a regenerative resistor which are connected across the D.C. buses 3, reference numeral 13 denotes a bus voltage measuring apparatus for measuring a bus voltage of the D.C. buses 3, and reference numeral 14 denotes a charging/discharging state measuring circuit for measuring a charging/discharging state of the power accumulator 9. The above-mentioned charge/discharge control circuit 8 controls the charge/discharge of the above-mentioned power accumulator 9 on the basis of a measured value from the bus voltage measuring apparatus 13 and a measured value from the above-mentioned charging/discharging state measuring circuit 14.

Here, the above-mentioned power accumulator 9, as in an example of a circuit shown in FIG. 6, is constructed by a secondary battery 90 of nickel-hydrogen or the like and a DC-DC converter for controlling charge/discharge of the secondary battery 90. The DC-DC converter includes a reactor 91, switching elements 92 and 93 such as IGBTs, and diodes 94 and 95 which are respectively connected in antiparallel with the switching elements 92 and 93. The charge for the secondary battery 90 is carried out with a step-down chopper circuit of the switching element 92 as the charge gate and the diode 95, while the discharge from the secondary battery 90 is carried out with a boosting type chopper circuit of the switching element 93 as the discharge gate and the diode 94. These gates are controlled by the charge/discharge control circuit 8.

In general, in order that the power accumulator 9 may be configured so as to be small and of low cost, the number of secondary battery 90 is reduced to be less, and hence the output voltage of the batteries is lower than the voltage across the D.C. buses 3. The voltage across the D.C. buses 3 is basically controlled so as to become near a voltage Vp which is obtained by rectifying the voltage of the three-phase A.C. power source 1. Thus, when charging the batteries with electricity, an input voltage to the power accumulator 9 needs to be decreased as a value lower than the voltage Vp down to the bus voltage, and also during the discharge, an output voltage of the power accumulator 9 needs to be increased or decreased as a value higher than the voltage Vp from or to the bus voltage. For this reason, the DC-DC converter is adopted.

In addition, a quantity exhibiting the degree of charge for the power accumulator 9 is called an SOC (state of charge), and this state of charge, SOC, is calculated on the basis of the difference between a quantity of charged current and a quantity of discharged current as described above. That is to say, a quantity of charged current is set plus, and a quantity of discharged current is set minus with the state of full charge of the power accumulator 9 as 100% to calculate the current SOC, i.e., a quantity of charge.

When the three-phase commercial power source 1 is in the state of a power failure, the operation of the elevator becomes possible through the power source supply from the power accumulator 9. In general, the secondary battery is used in the form in which sets of batteries each having about ten or less plural cells connected in series with one another are further connected in series with one another. However, if, for example, the number of series combinations of the secondary battery is selected so as to have the charge/discharge capability with which about one half the rated output of a motor depending on the speed and the load capacity of an elevator, then all of the regenerative powers can be charged since the regenerative power is about one half the rated electric power, and hence the maximum effect can be expected for the energy saving. In addition, at the time of a power failure, period of time (distance) during which the operation is possible is determined on the basis of a quantity Wh of power accumulated in the power accumulator 9. Conversely, if from the SOC in the normal running before a power failure to the SOC from start to finish of the discharge (here, the SOC from start to finish of the discharge means the SOC in which the discharge is possible in the range of not degrading batteries, and hence if the power is supplied in order to operate an elevator, then the terminal voltage of the secondary battery is abruptly decreased so that the desired power can not be supplied in some cases) is from 70% to 30% for example, in this case, when a quantity of power required to operate an elevator for a predetermined period of time in a power failure is 40% of the rated power, the number of series combinations of the secondary battery can be selected accordingly.

FIG. 7 is a flow chart showing the control for the charging gate and the discharging gate made by the charge/discharge control circuit 8. First of all, for example, the bus voltage is measured with the bus voltage measuring apparatus 13 (Step S1), and the measured voltage is compared with a desired voltage set value exhibiting the regenerative state (the desired voltage set value is equal to or smaller than a voltage set value which is set in the discharge control as will be described later, and is the value exhibiting the regenerative state which the D.C. bus voltage rises due to the regenerative power from a motor) to judge whether or not the measured voltage exceeds the voltage set value (Step S2).

If it is judged that the measured voltage does not exceed the set value, then it is judged that the operation of the elevator is the power running operation. Next, it is judged whether or not the measured value of a quantity of charge SOC of the secondary battery obtained with the charging/discharging state measuring circuit 14 exceeds a predetermined value (Step S3). If the measured quantity exceeds the set value, then the discharge control is started (Step S5). The set SOC in step S3, for example, is set to about 70%, and then a quantity of charge of the secondary battery is controlled so as to be held at 70%. In addition, in order to prevent the charge control start and the discharge control stop from being frequently repeated, the hysteresis of about 5% which can not be discharged off is held in one motion of the elevator, 75% is made the set SOC of the discharge control start, and 70% is made the set SOC of the discharge stop, which makes it possible to carry out the control with higher precision.

If it is judged in Step S2 that the measured voltage exceeds the set value, then it is judged that the operation of the elevator is the regenerative operation. Next, it is judged whether or not the measured value of the charge quantity SOC of the secondary battery obtained with the charging/discharging state measuring circuit 14 has exceeded an upper limit value exhibiting the limit of charge (Step S4). If the measured quantity exceeds the set value, then no charge control is carried out. If the measured quantity does not exceed the threshold, the charge control is started (Step S6). Here, the upper limit value exhibiting the limit of charge means the value in the range of about 80% to about 100% and means the upper limit value of over-charge which does not promote the degradation of the batteries.

FIG. 8 is a flow chart showing the control during the discharge made by the charge/discharge control circuit 8. While as the control system, the control having high stability for which the current control minor loop or the like is constructed in the voltage control may be carried out, in this case, the description will now be given with respect to the system for carrying out the control with the bus voltage for the sake of simplicity.

First of all, for example, the bus voltage is measured with the bus voltage measuring apparatus 13 (Step S11), and the measured voltage is compared with the desired voltage set value. Then, it is judged whether or not the measured voltage exceeds the voltage set value (Step S12). If the measured voltage does not exceed the set value, then it is judged whether or not the measured value of a discharge current of the secondary battery obtained with the charging/discharging state measuring circuit 14 has exceeded a predetermined value (Step S13).

From these judgements, when the measured voltage has exceeded the set value, or when even if the measured voltage has not exceeded the set value, the measured value of a discharge current of the secondary battery has exceeded a predetermined value, the adjustment time DT is subtracted from the current ON time to obtain new ON time in order to shorten the ON pulse width of the discharge gate (Step S14).

On the other hand, if it is judged in the above-mentioned Step S13 that the measured value of the discharge current of the secondary battery has not exceeded the predetermined value, the adjustment time DT is added to the current ON time to obtain new gate ON time in order to lengthen the ON pulse width of the discharge gate (Step S15). The ON control of the discharge gate is carried out on the basis of the gate ON time thus obtained, and also the resultant gate ON time is stored as the current ON time in a self-contained memory (Step S16).

In such a manner, lengthening the ON pulse width of the discharge gate increases the mean voltage as the output voltage of the power accumulator 9 and causes more current to flow through the buses from the secondary battery to increase the supply power and to increase the bus voltage across the D.C. buses 3 due to the power supply. When the power running operation is taken into consideration, the elevator requires the power supply and this power is provided from the discharge from the secondary battery and from the supply from the three-phase A.C. power source 1. If the bus voltage is controlled so as to get higher than the output voltage of the converter 2 based on the supply from the three-phase A.C. power source 1, then all of the powers are supplied from the secondary battery. However, the design is carried out in such a way that in order to construct the cost saving power accumulator, all of the powers are not supplied from the secondary battery, but are supplied at a suitable ration from the secondary battery and the three-phase A.C. power source 1.

That is to say, in FIG. 8, the measured value of the discharge current is compared with the current for partial charge of the supply (predetermined value). If the measured value of the discharge current exceeds the predetermined value, then the ON pulse width of the discharge gate is lengthened to further increase a quantity of supply, while if the measured value of the discharge current does not exceed the predetermined value, then the ON pulse width of the discharge gate is shortened, which results in that the power supply is clipped by carrying out that process repeatedly. If such a process is adopted, since of the power required for the inverter 4, the power supplied from the secondary battery is clipped, the bus voltage across the D.C. buses 3 is decreased, which results in that the power is started to be supplied from the converter 2. Since these processes are carried out for a very short period of time, practically, the voltage concerned settles to the suitable bus voltage to supply the power required for the elevator so that it becomes possible to supply the power at the desired ratio from the secondary battery 90 and the three-phase A.C. power source 1.

Next, the description will hereinbelow be given with respect to a flow chart during the charge control shown in FIG. 9.

When the regenerative power is supplied from an A.C. motor (not shown) for rotating and driving the hoisting machine 5, the bus voltage across the D.C. buses 3 is increased due to the supply of the regenerative power. When this voltage becomes higher than the output voltage of the converter 2, the power supply from the three-phase A.C. power source 1 is stopped. If this state continues when no power accumulator 9 is provided, while it is not illustrated because it is known, since the voltage across the D.C. buses 3 is increased, when the measured voltage value of the bus voltage across the D.C. buses 3 has reached a certain predetermined voltage, the regenerative control circuit 10 is operated to disable the regenerative control gate 11 constructed by a switching element or a contact.

As a result, the power is supplied to the regenerative resistor 12 and the regenerative power is consumed in the resistor and also the elevator is decelerated due to the electromagnetic braking effect. However, when the power accumulator 9 is provided, before the voltage concerned has been increased to the voltage at which the power is supplied to the regenerative resistor 12, the power accumulator 9 is charged with this regenerative power in accordance with the control made by the charge/discharge control circuit 8.

That is to say, as shown in FIG. 9, if the measured value of the bus voltage across the D.C. buses 3 obtained with the bus voltage measuring apparatus 13 exceeds the predetermined voltage, then the charge/discharge control circuit 8 detects that the state concerned is the regenerative state, and then lengthens the ON pulse width of the charge gate, thereby increasing the charge current to the secondary battery 90 (Steps S21–S22–S23). In a short time, the regenerative power from the elevator becomes less, and the voltage across the D.C. buses 3 is decreased accordingly so that the measured value obtained with the bus voltage measuring apparatus 13 does not to exceed the predetermined voltage, the control is carried out so as to shorten the ON pulse width of the charge gate and also the charge power is controlled so as to become less (Steps S21–S22–S24).

In such a manner, the bus voltage across the D.C. buses 3 is monitored to control the charge power, thereby controlling the bus voltage in the suitable range to carry out the charge. In addition, heretofore, the power consumed in the form of the regenerative power is accumulated to be reutilized, thereby realizing the energy saving. Thus, the current and voltage of the charge and discharge in the power accumulator 9 is usually controlled with the DC-DC converter, and the difference between the total of a quantity of charged current and the total of a quantity of discharged current becomes the charge quantity which currently remains in the power accumulator 9.

However, in the above-mentioned conventional elevator control apparatus, for continuation of the operation during a power failure of the commercial power source, it is necessary to supply the power, in addition to the driving power for the elevator, to a controller, and an illumination circuit. In addition, while for continuation of the service of the elevator, it is necessary to use effectively and usefully a quantity of charged power in the power accumulator 9, for example, if the power is supplied to all of the circuits during a power failure of the commercial power source, then there arises a problem in that before the elevator is moved to an objective floor of the passenger on board the car, the remaining power of a quantity of charged power in the power accumulator 9 is lost so that the elevator can not to be moved, and so forth. In addition, when the commercial power source is recovered, the operation of the elevator which has been restricted needs to be returned back to the original state.

The present invention has been made in order to solve the problems as described above, and therefore, it is an object of the present invention to obtain an elevator control apparatus which is capable of when a power failure of the commercial A.C. power source is detected, using effectively and usefully a quantity of charged power in a power accumulator and of when recovering the power supply, returning an elevator back to the original service to make the proper running possible.

DISCLOSURE OF THE INVENTION

In order to attain the above-mentioned object, according to the present invention, there is provided an elevator control apparatus, including: a converter for converting an A.C. power from an A.C. power source into a D.C. power through rectification; an inverter for converting the D.C. power from the converter into an A.C. power of a variable voltage and a variable frequency to drive an electric motor to operate the elevator; a power accumulator provided across D.C. buses between the converter and the inverter for accumulating therein a D.C. power from the D.C. buses in a regenerative operation of the elevator to supply the D.C. power accumulated in a powering operation to the D.C. buses; a charge/discharge control circuit for controlling the charge/discharge of the power accumulator for the D.C. buses; a charging/discharging state measuring circuit for measuring a quantity of charged power or a charging/discharging state of the power accumulator; a power failure detector for detecting a power failure of the A.C. power source; a control power supply device for supplying the power to the elevator control apparatus during a power failure; an illumination power supply device for supplying the power to an illumination circuit of the elevator during a power failure; and control means for, when a power failure is detected with the power failure detector, supplying the power of the power accumulator to the inverter and supplying the power to control circuits and the illumination circuit of the elevator with the charge/discharge control circuit to continue the operation of the elevator.

Further, the elevator control apparatus according to the present invention is characterized in that the control means, when a power failure is detected, limits speed of the elevator.

Further, the elevator control apparatus according to the present invention is characterized in that the control means, when a power failure is detected, selectively cuts off the illumination circuit of the elevator to limit the power supply in order to secure the necessary illumination and cut off a cable way to unnecessary illumination.

Further, the elevator control apparatus according to the present invention is characterized in that the control means, when a power failure is detected, selectively cuts off the control circuits of the elevator in order to secure only the control circuits of the control circuits required for the operation and cut off a cable way to the unnecessary control circuits.

Further, the elevator control apparatus according to the present invention is characterized in that the control means, after a power failure is detected, when the operation of the elevator is being continued, if a measured value obtained with the charging/discharging state measuring circuit has become equal to or smaller than a set value, or a predetermined period of time has elapsed, stops the operation of the elevator.

Further, the elevator control apparatus according the present invention is characterized in that the control means informs a passenger that the operation of the elevator will be stopped.

The elevator control apparatus according to the present invention further includes a power supply recovery detector for detecting power source recovery of the A.C. power source, and the system is characterized in that the control means, when power supply recovery is detected, returns speed of the elevator back to the original rated speed.

Further, the elevator control apparatus according the present invention is characterized in that the control means, when power supply recovery is detected, after the elevator is stopped if the elevator is being moved, returns the operation of the elevator from an operation mode at the time of a power failure to the normal operation mode to return speed thereof back to the original rated speed.

The elevator control apparatus according to the present invention further includes a power supply recovery detector for detecting power supply recovery of the A.C. power source, and the system is characterized in that the control means, when power supply recovery is detected, connects the control circuits or the illumination circuit which has been selectively cut off.

Further, the elevator control apparatus according to the present invention is characterized in that the control means is provided with both a continuous operation mode at the time of a power failure at which the operation of the elevator is continued, and a rescue operation mode at which the elevator is moved at low speed to be stopped at the nearest floor, and the control means selects the operation mode on the basis of a measured value obtained with the charging/discharging state measuring circuit or a lapse of a predetermined period of time from a power failure.

Further, the elevator control apparatus according to the present invention is characterized in that the control means selects the rescue operation mode on the basis of the measured value obtained with the charging/discharging state measuring circuit or a lapse of a predetermined period of time from a power failure to prevent the passenger from being shut in the elevator due to the insufficiency in quantity of charged power in the power accumulator.

Further, the elevator control apparatus according the present invention is characterized in that the control means, when the measured value obtained with the charging/discharging state measuring circuit becomes equal to or smaller than a first set value, or when a lapse of time from a power failure becomes equal to or larger than the first set value, does not receive the hall call so as not to allow getting-in of a new passenger and to carry out the service for the car call by the passenger currently on board, and when the measured value obtained with the charging/discharging state measuring circuit becomes equal to or smaller than a second set value, or when a lapse of time from a power failure becomes equal to or larger than the second set value, selects the rescue operation mode to prevent the passenger from being shut in the elevator due to insufficiency in quantity of charged power in the power accumulator.

Further, the elevator control apparatus according to the present invention is characterized in that the second set value of the quantity of charged power is equal to or smaller than the first set value, and the second set value for the elapsed time from a power failure is equal to or larger than the first set value.

BEST MODE FOR CARRYING OUT THE INVENTION

In the present invention, during a power failure of the commercial A.C. power source, the operation of an elevator is exclusively carried out through the power supply from a power accumulator 9. At this time, the elevator continues to be operated without stop. For this reason, it is necessary to supply the power, in addition to the driving power for the elevator, to a controller and an illumination circuit.

In addition, for continuation of the service of the elevator, it is necessary to use effectively and usefully a quantity of charged power in the power accumulator 9. However, for example, if the power is supplied to all of the circuits during a power failure of the commercial power source, there arises a problem in that before the elevator is moved to an objective floor of the passenger on board, the remaining power of a quantity of charged power of the power accumulator 9 gets lost, so that the elevator cannot be moved, and so forth. In addition, when the commercial power source is recovered, the operation of the elevator which has been restricted needs to be returned back to the original state.

Figure 1:
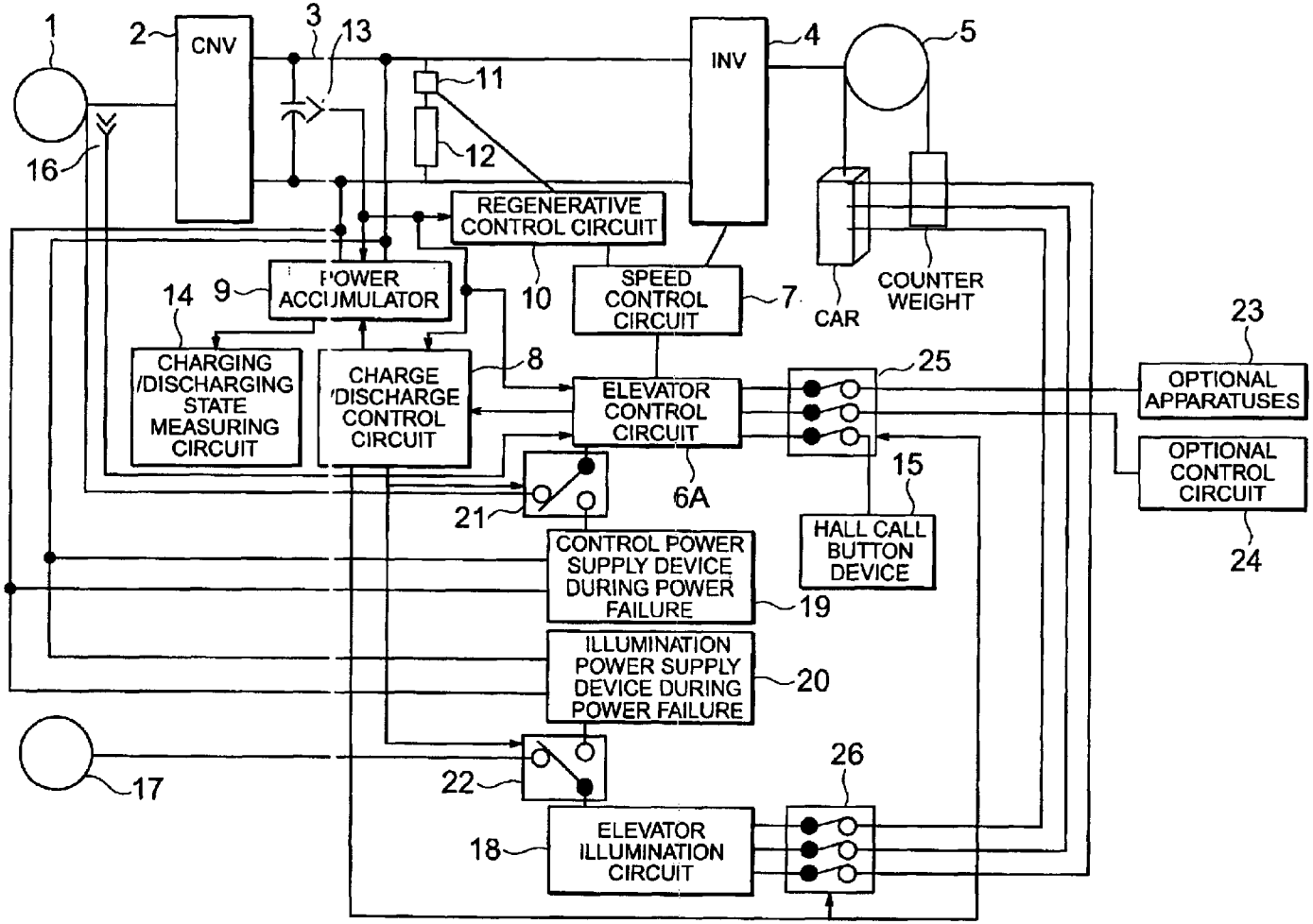
FIG. 1 is a block diagram showing a configuration of an elevator control apparatus according to the present invention.
Figure 5:
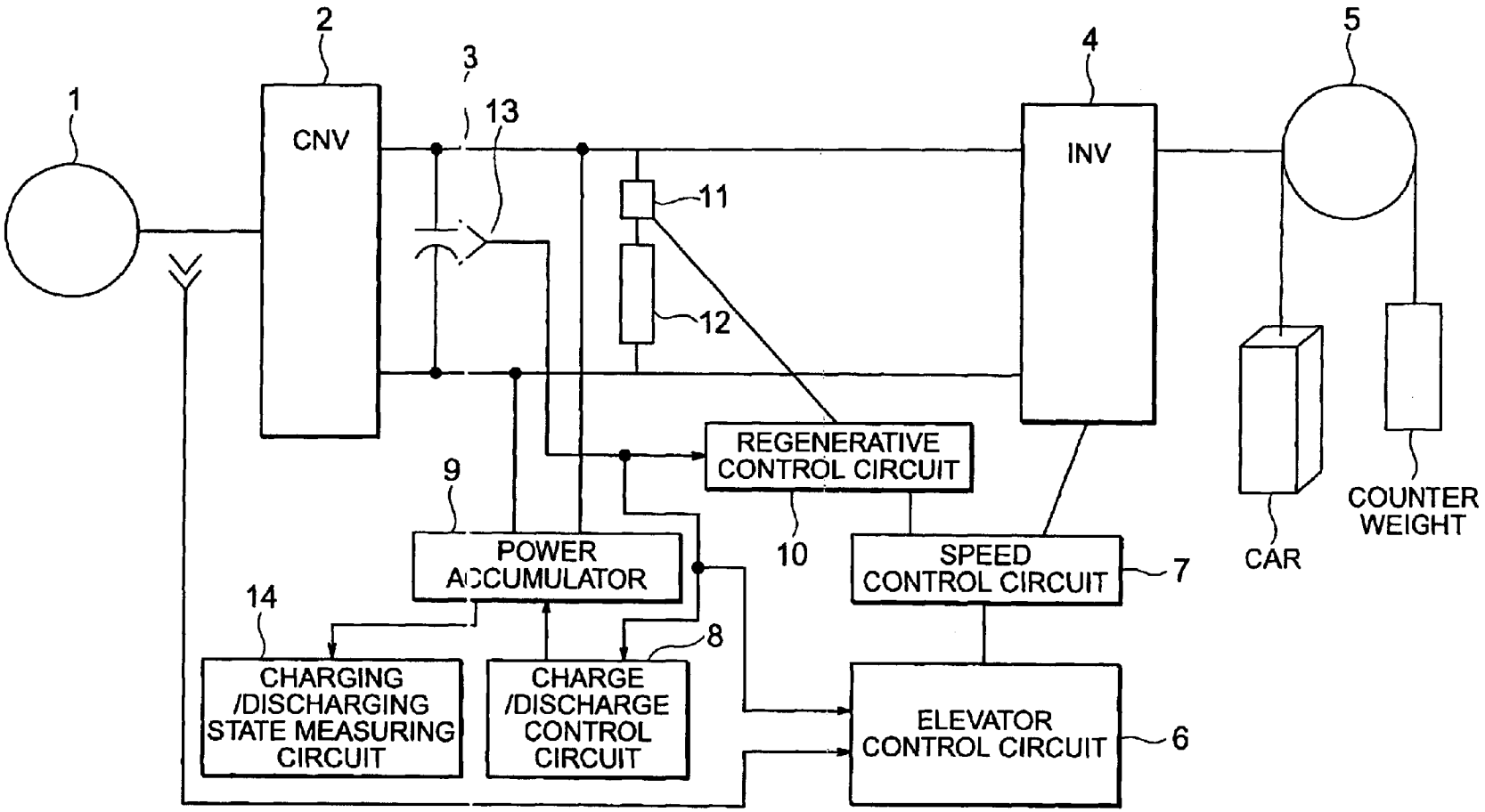
FIG. 5 is a block diagram showing a configuration of a conventional elevator control apparatus.
Figure 6:
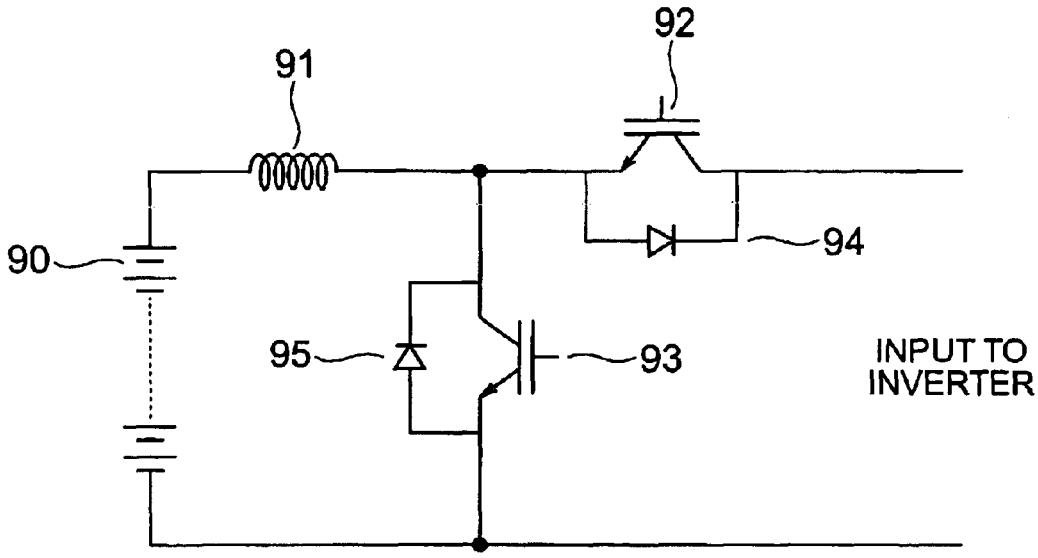
FIG. 6 is a structural diagram showing an internal circuit of a power accumulator 9 shown in FIG. 5.
Figure 7:
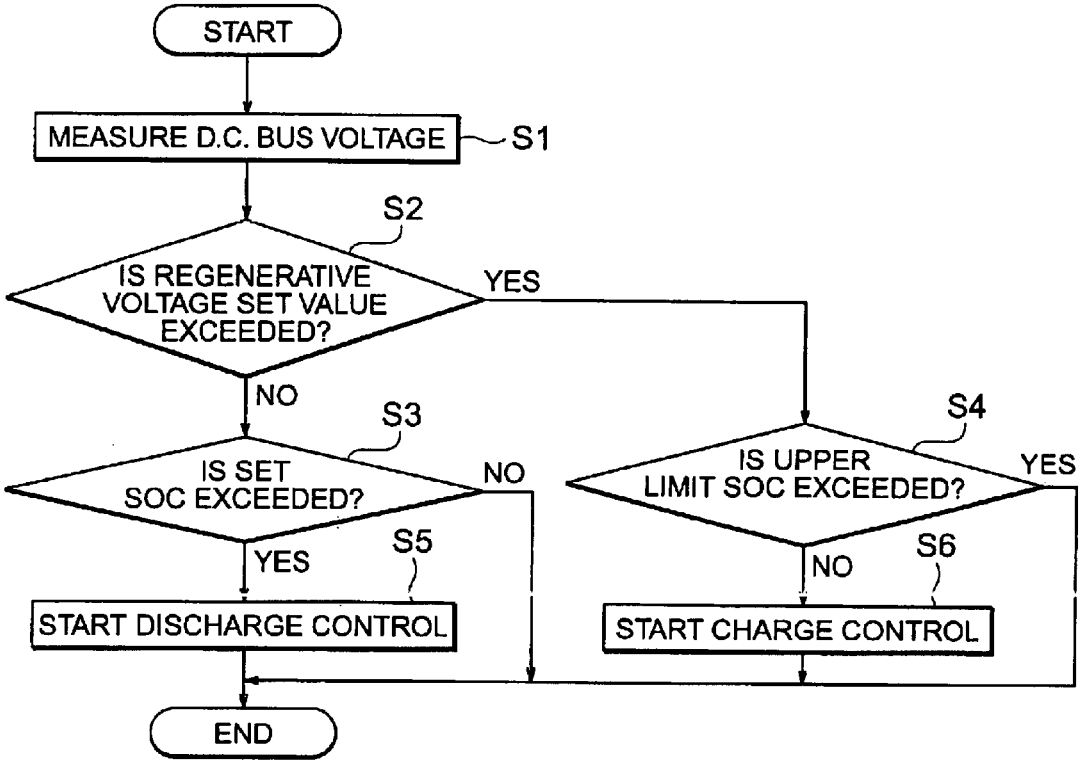
FIG. 7 is a flow chart showing charge/discharge control made by a charge/discharge control circuit 8 shown in FIG. 5.
Figure 8:
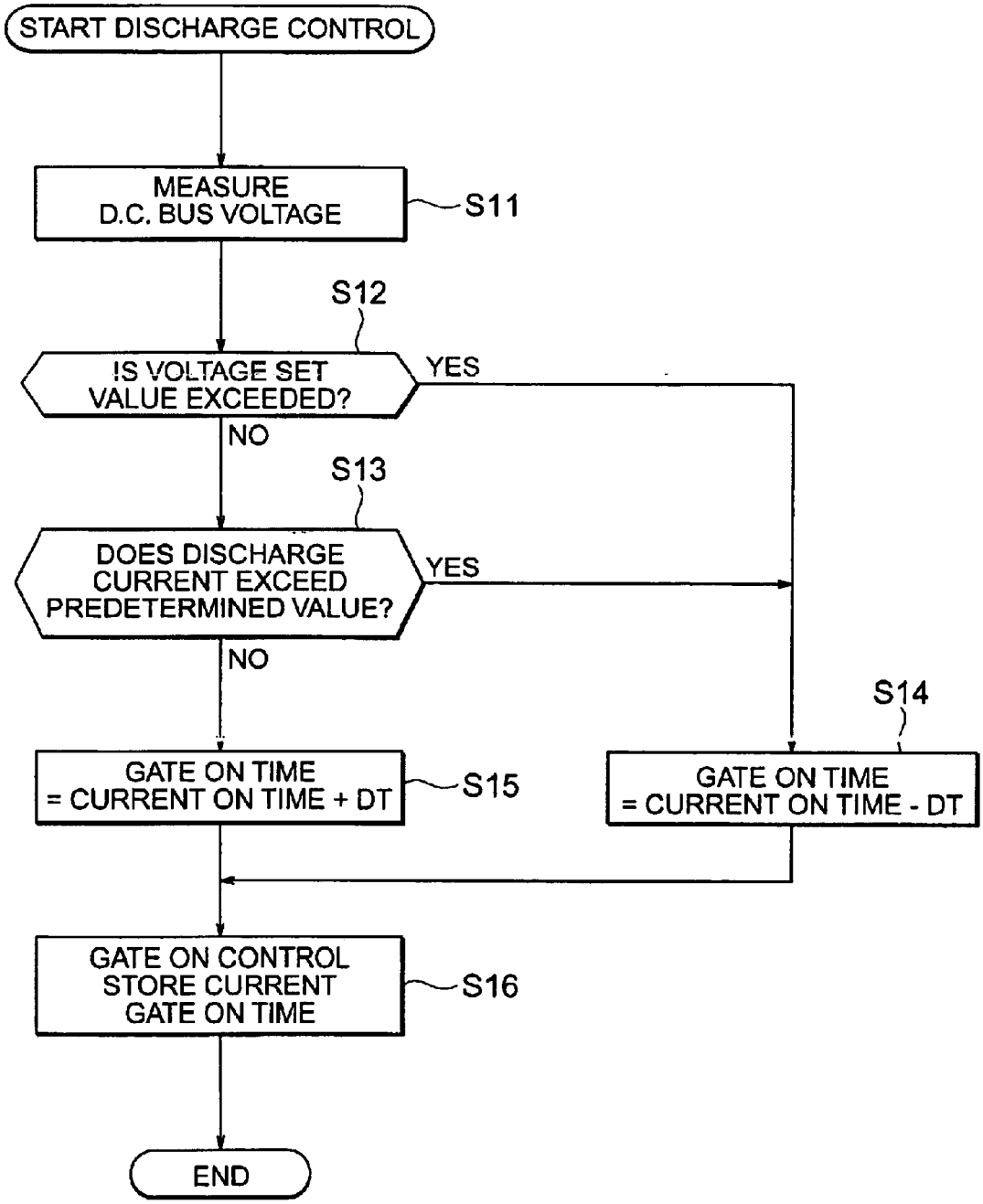
FIG. 8 is a flow chart showing control during discharge made by the charge/discharge control circuit 8 shown in FIG. 5.
Figure 9:
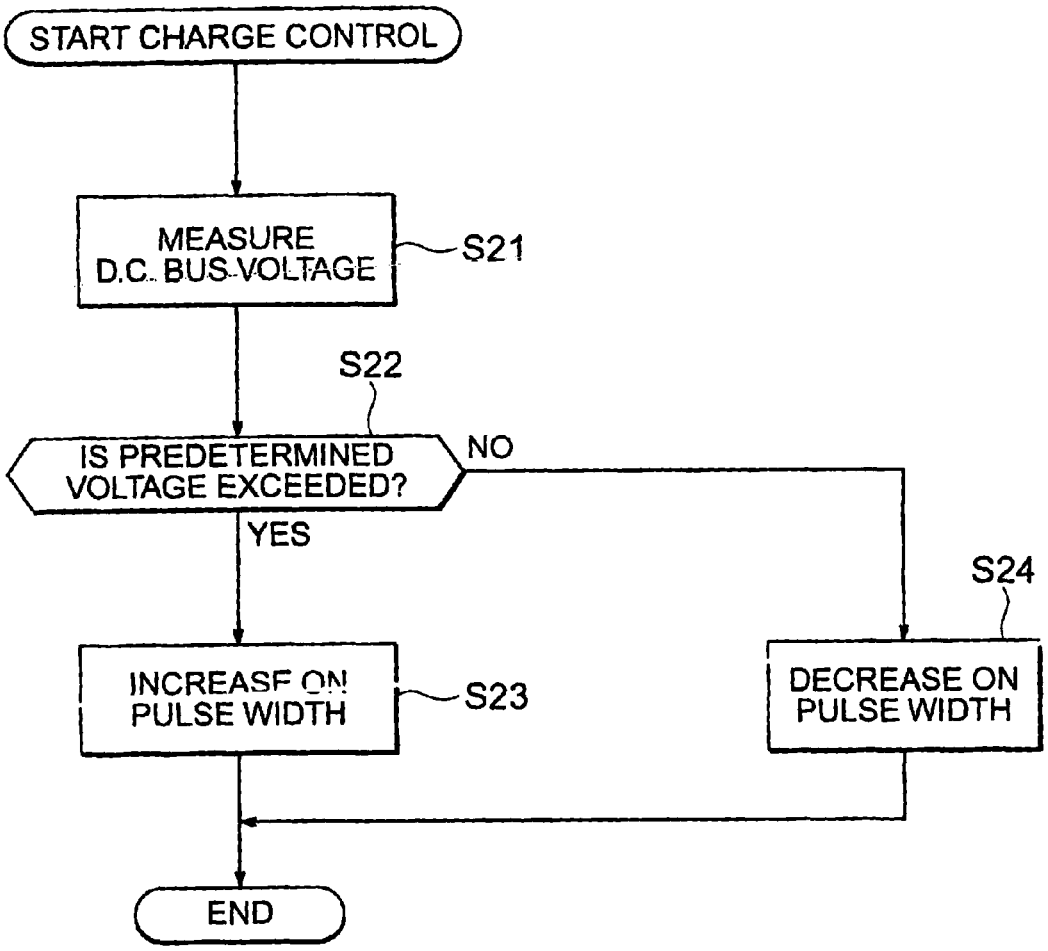
FIG. 9 is a flow chart showing control during charge made by the charge/discharge control circuit 8 shown in FIG. 5.

FIG. 1 is a block diagram showing a configuration of an elevator control apparatus according to the present invention. In the figure, the same constituent elements as those of the prior art example shown in FIG. 5 are denoted with the same reference numerals, and the description thereof is omitted here. As for new reference numerals, reference numeral 15 denotes a hall call button device and reference numeral 16 denotes a power failure detector or a power supply recovery detector for detecting a power failure or recovery of the power supply of the three-phase A.C. power source 1. Then, an elevator control circuit 6A as a control means according to the present invention is adapted to change an operation mode during the operation in a power failure of the three-phase A.C. power source 1 in accordance with an output of the charging/discharging state measuring circuit 14. By the way, while the illustration is omitted in FIG. 1, an output line of the charging/discharging state measuring circuit 14 is connected to the elevator control circuit 6A.

In addition, reference numeral 17 denotes a single-phase power source for illumination; reference numeral 18 denotes an illumination circuit; reference numeral 19 denotes a control power supply device for supplying the power to the elevator control apparatus during a power failure; reference numeral 20 denotes an illumination power supply device for supplying the power to an illumination circuit of the elevator during a power failure; reference numeral 21, a switch for, when a power failure is detected, switching a three-phase cable from the three-phase A.C. power source 1 and a three-phase cable of the control power supply device during a power failure 19 over to each other; and 22, a switch for, when a power failure is detected, switching a single-phase cable of the single-phase power source 17 for illumination and a single-phase cable of the illumination power supply device during a power failure 20 for supplying the power to the illumination circuit 18 over to each other.

Now, sometimes the power source of the illumination circuit 18 is the single-phase power source 17 for illumination, otherwise the power is supplied from the single-phase cable of the three-phase A.C. power source 1 through a transformer, for example. In addition, though it is not illustrated since it is known, for example, a three-phase inverter for converting a direct current into a three-phase alternating current is used for the control power supply device during a power failure 19, and a single-phase inverter for converting a direct current into a single-phase alternating current is used for the illumination power supply device during a power failure 20.

In addition, reference numeral 23 denotes optional apparatuses for information for example; reference numeral 24 denotes a control circuit for controlling the optional apparatuses; reference numeral 25 denotes a switch for selectively cutting off the cable way of the control circuit such as the power source for a hall call button if, for example, the hall call is not received during a power failure and optional apparatuses which are unnecessary during a power failure and the control circuit therefor in accordance with an instruction issued from the charge/discharge control circuit 8; and reference numeral 26 denotes a switch for, similarly to the switch 25, selectively cutting off the cable way of an unnecessary illumination circuit such as an in-car illumination and an in-car plug socket for the purpose of other than ensuring the illumination required at minimum in accordance with an instruction issued from the charge/discharge control circuit 8.

Next, the description will hereinbelow be given with respect to the operation during a power failure. At the time of detecting a power failure on the basis of a power failure detecting signal obtained with the power failure detector 16, the elevator control circuit 6A transmits a power failure signal to the charge/discharge control circuit 8 to start an operation at the time of a power failure. In response to the power failure signal from the elevator control circuit 6A, the charge/discharge control circuit 8 starts the operation at the time of a power failure and also controls the switch 21 to switch the cable way of the control power source from the three-phase cable of the three-phase A.C. power source 1 over to the three-phase cable of the control power supply apparatus during a power failure 19. Also, the charge/discharge control circuit 8 controls the switch 22 to switch the cable way of the power source of the illumination circuit 18 from the single-phase cable of the single-phase power source 17 for illumination over to the single-phase cable of the illumination power supply device during a power failure 20.

Thus, the power of the power accumulator 9 is supplied to the inverter 4 and also the power is supplied to the elevator control circuit 6A and the illumination circuit 18 by the charge/discharge control circuit 8 to continue the operation of the elevator. However, for continuation of the operation of the elevator, when the control power source of the elevator is switched from the three-phase cable of the three-phase A.C. power source 1 over to the three-phase cable of the control power supply device during a power failure 19, in order to prevent the control power source from being instantaneously stopped, the backup with other batteries, a capacitor or the like is required for the control power source only for a short period of time. In addition, the charge/discharge control circuit 8 cuts off the cable way which is unnecessary to the operation during a power failure of the elevator control circuit 6A and the illumination circuit 18 with the switches 25 and 26 to be able to use effectively and usefully a quantity of charged power of the power accumulator 9 and to continue effectively the operation during a power failure at maximum.

Figure 2:
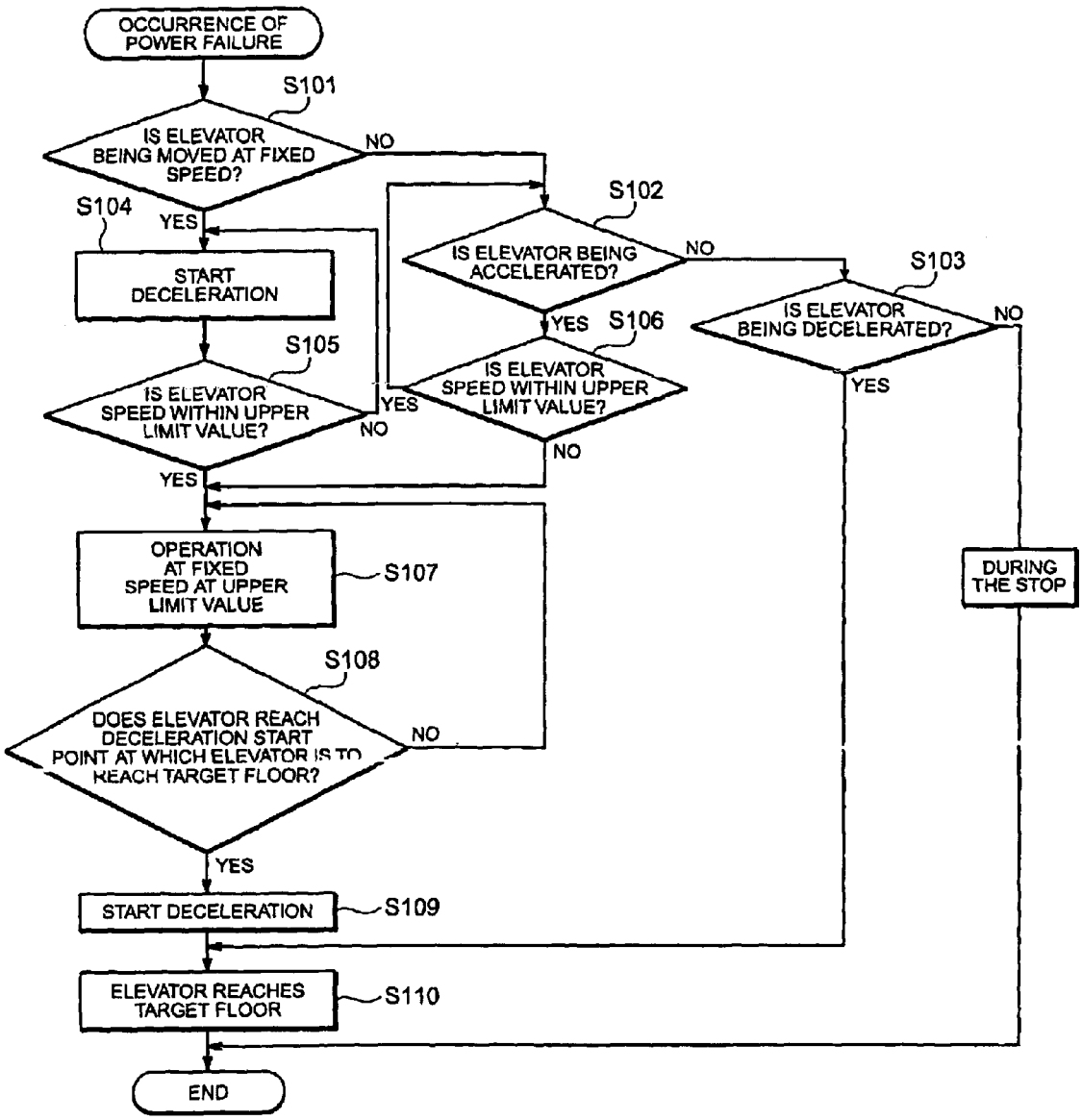
FIG. 2 is a flow chart showing a speed control operation of a control circuit for an elevator according to an embodiment of the present invention.

FIG. 2 is a flow chart showing the speed control for continuing the operation during a power failure made by the elevator control circuit 6A according to an embodiment mode of the present invention.

In this embodiment mode, the elevator control circuit 6A, after occurrence of a power failure, in order to continue the operation when the elevator is being moved, judges whether the elevator is being moved at a fixed speed, being accelerated, or being decelerated (Steps S101, S102, and S103). If the elevator is being moved at a fixed speed, after starting the deceleration at a predetermined deceleration speed to continue the deceleration until the speed of the elevator is decelerated within a set upper limit (Step S104), the elevator control circuit 6A completes the deceleration at a time point when the elevator speed reaches the upper limit (Step S105), and then the elevator is moved at a fixed speed at the upper limit (Step S107).

Next, it is judged whether or not the elevator speed has reached a deceleration start point for the purpose of landing on an objective floor (Step S108). If the elevator speed has reached the deceleration start point, the deceleration is started again (Step S109) and then the elevator is landed on the objective floor (Step S110) to complete the operation.

If it is judged in the above-mentioned Step S102 that the elevator is being accelerated, then the acceleration is continued within the upper limit to which the speed of the elevator is set (Step S106), and at a time point when the elevator speed has reached the upper limit, the process proceeds to Step S107 in order that the elevator may be moved at fixed speed at the upper limit. In addition, if it is judged in the above-mentioned Step S103 that the elevator is being decelerated, then the deceleration is continued and then the process proceeds to Step S110 in order that the elevator may be landed on the objective floor to complete the operation.

That is, for the operation of the elevator at occurrence of a power failure, the whole power required to drive the elevator must be supplied from the power accumulator 9 to the inverter, the elevator control circuit and the illumination circuit. Thus, due to the limit of the power which can be outputted from the power accumulator 9, the elevator is operated with its speed being decreased and the power is supplied only to the control power source and the illumination circuit which are required for the operation at minimum, thereby necessitating cutting off other cable ways, and so forth.

FIG. 2 is a control flow chart for decelerating the moving elevator to the speed upper limit value which is set in accordance with the power limit of the power accumulator 9, in order to continue the operation, due to the limit of the power accumulator 9. In this flow chart, from a time point of occurrence of a power failure, the speed state of the elevator is classified into "moving at fixed speed", "being accelerated", and "being decelerated", and the elevator speeds in these states are limited to the respective speed upper limits.

Figure 3:
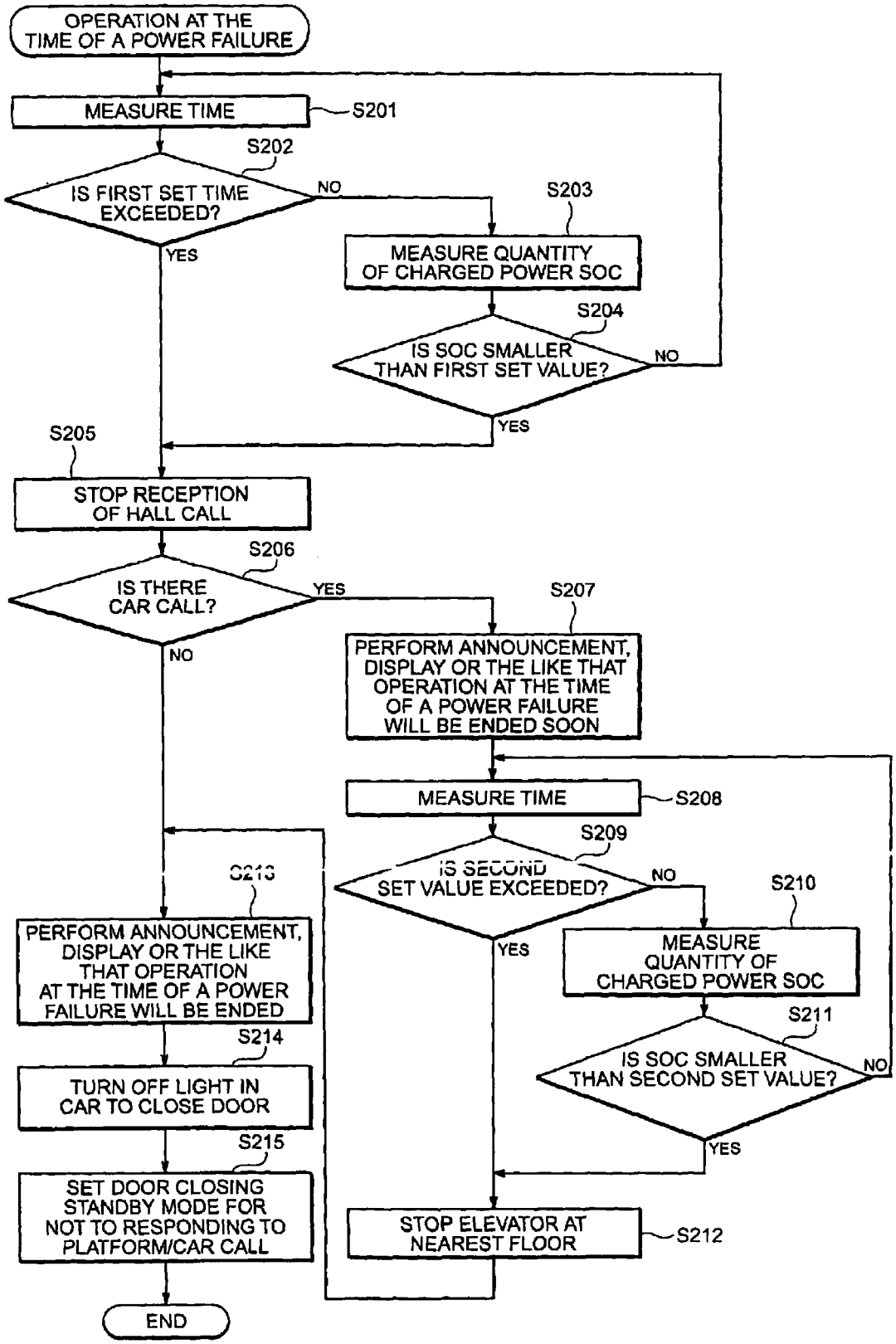
FIG. 3 is a flow chart showing a running stop control operation at the time of a power failure of an elevator control apparatus according to an embodiment of the present invention.

FIG. 3 is a flow chart showing the control for stopping the operation during a power failure which is made by the elevator control circuit 6A according to an embodiment mode of the present invention.

More specifically, the elevator control circuit 6A and the charge/discharge control circuit 8 start the operation at the time of a power failure on the basis of a power failure detecting signal obtained with the power failure detector 16.

First of all, the elapsed time from the start of the operation at the time of a power failure is measured to judge whether or not the elapsed time therefrom has exceeded a first set time which is set (Step S201, Step S202). If the elapsed time has exceeded the first set time which is set, then the reception of the hall call from the hall call button device 15 is prohibited (Step S205).

If the elapsed time does not exceed the first set time, it is next judged whether or not the measured value (a quantity of remaining charged power in the power accumulator 9) of the charging state SOC obtained with the charging/discharging state measuring circuit 14 is lower than the first set value (e.g., the quantity of remaining charged power is 40%)(Steps S203, S204). If the measured value of the charging state SOC is not lower than the first set value, then the operation at the time of a power failure is continued. If the measured value of the charging state SOC is lower than the first set value, then the reception of the hall call from the hall call button device 15 is prohibited (Step S205).

Next, it is judged whether or not the car call is present or absent (Step S206). While if there is the car call, the elevator is moved to an objective floor for the passengers currently already in the car, for the purpose of checking getting-in from a floor on which the elevator is stopped, the report of the announcement, the display, or the like that the operation at the time of a power failure will be ended soon is carried out (Step S207).

Next, the elapsed time from the start of the operation at the time of a power failure is measured again to judge whether or not the measured time has exceeded a second set time (Step S208, Step S209). If the measured time has exceeded the second set time, for the purpose of preventing the elevator from becoming unable to be moved between floors due to the insufficient quantity of charged power to shut the passengers in the elevator, the elevator is landed at the nearest floor (Step S212).

If the measured time does not exceed the second set time, then it is judged whether or not the measured value (a quantity of remaining charged power in the power accumulator 9) of the charging state SOC obtained with the charging/discharging state measuring circuit 14 is lower than a second set value (e.g., the quantity of remaining charged power is 30%)(Steps S210, S211). If the measured value of the charging state SOC is not lower than the second set value, then the operation at the time of a power failure is continued. If the measured value of the charging state SOC is lower than the second set value, then the rescue operation mode in which the elevator is moved at low speed to be landed at the nearest floor is selected to land the elevator at the nearest floor, thereby preventing the passengers from being shut in the elevator due to the insufficient quantity of charged power in the power accumulator 9 (Step S212).

Next, in order to inform the passengers of that the operation has been ended, the report of the announcement, the display, or the like that the operation at the time of a power failure will be ended is carried out for the passengers (Step S213) to turn off the light within the car to close the door to provide the door closing standby mode (Steps S206 to S208).

Thus, when a power failure of the commercial A.C. power supply is detected, the quantity of remaining charged power in the power accumulator 9 is monitored, and the control power source and the illumination power source are usually backed up, so that monitoring the elapsed time makes it possible to effectively utilize a quantity of power accumulated in the power accumulator 9 to prevent the inconvenience such as bringing the operation of the elevator on the way to an objective floor for the passengers on board to an end due to the insufficient quantity of remaining power in the power accumulator 9.

In addition, the report such as the announcement, the display, or the like that the operation at the time of a power failure will be ended soon, and moreover the report such as the announcement, the display, or the like that the operation at the time of a power failure has been ended are stepwisely carried out, thereby being able to remove the uneasiness of the passengers and to carry out the operation of the elevator which is convenient even at the time of the power failure.

In this case, such a system is adopted that when the charge/discharge control circuit 8 has received the stop signal from the elevator control circuit 6A, the operation proceeds to the operation at the time of a power failure. However, the charge/discharge control circuit 8 can detect a power failure by itself on the basis of the reduction in bus voltage of the inverter. Thus, such a system may also be adopted that when the bus voltage of the inverter has been decreased down to the value equal to or smaller than a predetermined value, the operation proceeds to the operation at the time of a power failure. In addition, such a system is adopted that the switching of the cable way to the control power supply device during a power failure 19 with the switch 21, the switching of the cable way to the illumination power supplying device during a power failure 20 with the switch 22, and the selective cut-off of the cable way of the control circuits or the illumination circuit with the switches 25 and 26 are carried out in the charge/discharge control circuit 8. However, the same effects can be offered even in a system in which such operations are carried out by the elevator control circuit 6A.

In addition, such a system may also be adopted that a continuous operation mode at the time of a power failure in which the operation of an elevator is continued, and a rescue operation mode in which an elevator is moved at low speed to be landed at the nearest floor are both provided in the elevator control circuit 6A, and the operation mode may be selected on the basis of a measured value obtained with the charging/discharging state measuring circuit 14, or a lapse of a predetermined period of time from a power failure.

Next, the description will hereinbelow be given with respect to the operation during recovery of the power supply. When detecting the recovery of the power supply on the basis of a power supply recovery signal obtained with the power supply recovery detector 16, the elevator control circuit 6A transmits a power supply recovery signal to the charge/discharge control circuit 8 to carry out the recovery from the operation at the time of a power failure. In accordance with the recovery signal from the elevator control circuit 6A, the charge/discharge control circuit 8 controls the switch 21 to switch the control power source from the three-phase cable of the control power supply device during a power failure 19 over to the three-phase cable of the three-phase A.C. power source 1. In addition, the charge/discharge control circuit 8 controls the switch 22 to switch the power source of the illumination circuit 18 from the single-phase cable of the illumination power supplying device during a power failure 20 over to the single-phase cable of the single-phase power source 17 for illumination. Also, the control circuits and the illumination circuit are connected which have selectively cut off with the switches 25 and 26. Thus, the circuitry is recovered to the state before the power failure. However, since the quantity of charged power of the power accumulator 9 was consumed in the operation at the time of a power failure, for making provision for a next power failure, it is necessary to charge the power accumulator 9 with electricity in such a way that the quantity of charged power of the power accumulator 9 becomes up to a predetermined value. Thus, the discharge is stopped and in addition to the regenerative power for the elevator, the charge is carried out from the power source as well.

Figure 4:
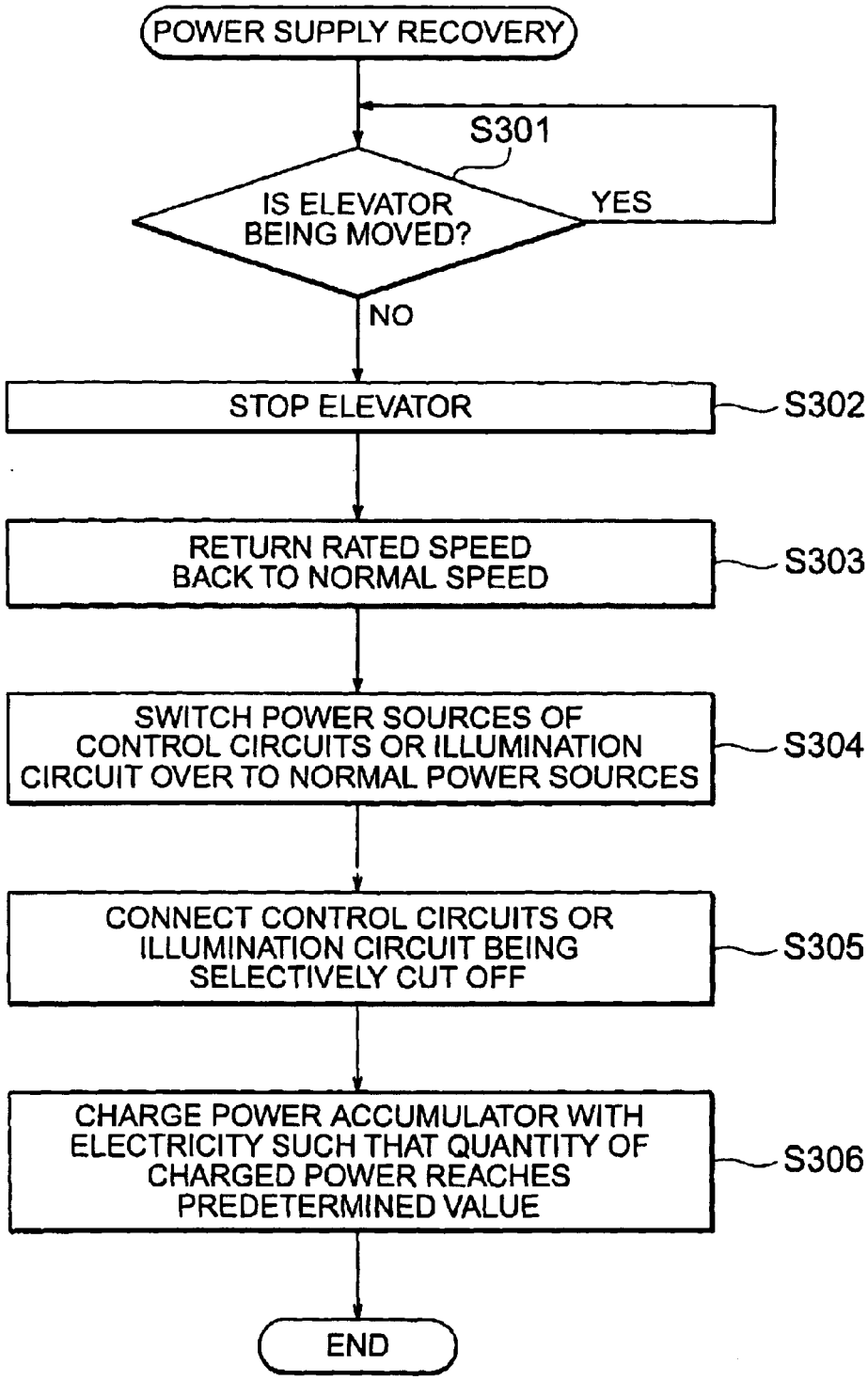
FIG. 4 is a flow chart showing a power supply recovery control operation of an elevator control apparatus according to an embodiment of the present invention.

FIG. 4 is a flow chart showing the control for the recovery of the power supply.

After recovery of the power supply, the elevator control circuit 6A and the charge/discharge control circuit 8 judges whether or not the elevator is being moved (Step S301). If the elevator is being moved, then the operation at the time of a power failure is continued until the elevator is stopped, and after the elevator is stopped, the operation mode is recovered from the operation at the time of a power failure mode to the normal operation mode to return the rated speed which was reduced in the operation at the time of a power failure back to the original normal speed (Step S303).

Next, the switch 21 is controlled to switch the control power supply from the cable way of the control power supply device during a power failure 19 over to the three-phase cable of the three-phase A.C. power source 1. Also, the switch 22 is controlled to switch the power source of the illumination circuit 18 from the single-phase cable of the illumination power supplying device during a power failure 20 over to the single-phase cable of the single-phase power source 17 for illumination (Step S304). Next, the switches 25 and 26 are controlled to connect the control circuits or the illumination circuit which has been selectively cut off (Step S305). Next, the power accumulator 9 is charged with electricity in such a way that the quantity of charged power thereof reaches a predetermined value (e.g., 70% as the value at which even if the next power failure occurs, the operation at the time of a power failure can be performed) (Step S306).

As set forth hereinabove, the elevator control apparatus according to the present invention is constructed in such a way that during a power failure, in addition to the driving power for an elevator, the power is supplied to the control apparatuses and the illumination circuit and speed of the elevator is also decreased down to a predetermined value, thereby enabling to continue the operation.

In addition, the control circuits or the illumination circuit which is unnecessary in the operation at the time of a power failure are selectively cut off. Consequently, the quantity of power of the power accumulator can be used effectively and usefully.

Also, the control system having high accuracy can be obtained which is capable of, when the power supply is recovered, returning the elevator back to the original service to make the proper operation possible.

INDUSTRIAL APPLICABILITY

As has been described above, according to the present invention, there is obtained an elevator control apparatus which is capable of, when a power failure of the commercial A.C. power source is detected, using effectively and usefully a quantity of charged power in a power accumulator and when recovering the power supply, returning an elevator back to the original service to make the proper operation possible.

What is claimed is:

1. An elevator control apparatus, comprising:

a converter for converting A.C. power from an A.C. power source into D.C. power;

an inverter connected to the converter by D.C. buses for converting the D.C. power from the converter into A.C. power having a variable voltage and a variable frequency to drive an electric motor to operate an elevator;

a power accumulator connected across the D.C. buses for accumulating D.C. power from the D.C. buses during regenerative operation of the electric motor and for supplying D.C. power accumulated to the electric motor during a powered operation of the electric motor;

a charge/discharge control circuit for controlling charging and discharging of the power accumulator;

a charging/discharging state measuring circuit for measuring state of charge of the power accumulator;

a power failure detector for detecting failure of the A.C. power source, a control power supply device for supplying power to the elevator control apparatus during a failure of the A.C. power source;

an illumination power supply apparatus for supplying power to an illumination circuit of the elevator during a failure of the A.C. power source; and control means for, when a failure of the A.C. power source is detected by the power failure detector, supplying power from the power accumulator to the inverter, to control circuits, and to the illumination circuit of the elevator through the charge/discharge control circuit to continue operation of the elevator.

2. The elevator control apparatus according to claim 1, wherein the control means, when a failure of the A.C. power source is detected, limits speed of the elevator.

3. The elevator control apparatus according to claim 1, wherein the control means, when a failure of the A.C. power source is detected, selectively stops flow of power to the illumination circuit to conserve power for necessary illumination.

4. The elevator control apparatus according to claim 1, wherein the control means, when a failure of the A.C. power source is detected, selectively stops flow of power to some of the control circuits of the elevator so control circuits required for operation of the elevator receive power.

5. The elevator control apparatus according to claim 1, wherein the control means, after a failure of the A.C. power source is detected, when operation of the elevator continues, stops operation of the elevator if a measured value obtained with the charging/discharging state measuring circuit is not larger than a set value, or a predetermined period of time has elapsed.

6. The elevator control apparatus according to claim 5, wherein the control means informs a passenger that operation of the elevator will be stopped.

7. The elevator control apparatus according to claim 2, further comprising a power supply recovery detector for detecting power source recovery of the A.C. power source, wherein the control means, when power supply recovery is detected, returns the elevator to a rated speed.

8. An elevator control apparatus according to claim 7, wherein the control means, when power supply recovery is detected, after the elevator is stopped, if the elevator moves, returns operation of the elevator from an operation mode upon a failure of the A.C. power source to a normal operation mode at the rated speed.

9. The elevator control apparatus according to claim 3, further comprising a power supply recovery detector for detecting power supply recovery of the A.C. power source, wherein the control means, when power supply recovery is detected, supplies power to the control circuits or the illumination circuit from which power had been cutoff.

10. The elevator control apparatus according to claim 1, wherein the control means has a continuous operation mode at a failure of the A.C. power source, in which operation of the elevator is continued, and a rescue operation mode, in which the elevator is moved at low speed and stopped at a nearest floor, and the control means selects the operation mode based on a measured value obtained by the charging/discharging state measuring circuit or lapse of a first predetermined period of time from a failure of the A.C. power source.

11. The elevator control apparatus according to claim 10, wherein the control means selects the rescue operation mode based on the measured value obtained by the charging/discharging state measuring circuit or lapse of the first predetermined period of time from a failure of the A.C. power source to prevent a passenger from being shut in the elevator due to insufficient power in the power accumulator.

12. The elevator control apparatus according to claim 10, wherein the control means, when the measured value obtained by the charging/discharging state measuring circuit is no larger than a first set value, or when a lapse of time from a failure of the A.C. power source is at least equal to the first predetermined period, does not receive a hall call for entry of a new passenger into the elevator and to service a car call by a passenger currently on board the elevator, and when the measured value obtained by the charging/discharging state measuring circuit is no larger than a second set value, or when a lapse of time from a failure of the A.C. power source becomes equal to a second predetermined period, selects the rescue operation mode to prevent the passenger from being shut in the elevator due to insufficient power in the power accumulator.

13. The elevator control apparatus according to claim 12, wherein the second set value is no larger than the first set value, and the second predetermined period is at least equal in length to the first predetermined period.

14. The elevator control apparatus according to claim 4, further comprising a power supply recovery detector for detecting power supply recovery of the A.C. power source, wherein the control means, when power supply recovery is detected, supplies power to the control circuits or the illumination circuit from which power had been cut off.

* * * * *